US007030819B2

(12) United States Patent
Horibe

(10) Patent No.: US 7,030,819 B2
(45) Date of Patent: Apr. 18, 2006

(54) RE-RADIATING ANTENNA SYSTEM

(75) Inventor: Akio Horibe, Tokyo (JP)

(73) Assignee: Uniden Corporation, Tokyo (JP)

( * ) Notice: Subject to any disclaimer, the term of this patent is extended or adjusted under 35 U.S.C. 154(b) by 0 days.

(21) Appl. No.: 10/915,471

(22) Filed: Aug. 11, 2004

(65) Prior Publication Data

US 2005/0057405 A1 Mar. 17, 2005

(30) Foreign Application Priority Data

Aug. 27, 2003 (JP) ..... 2003-303550

(51) Int. Cl.
*H01Q 1/24* (2006.01)

(52) U.S. Cl. ..... 343/702; 343/718

(58) Field of Classification Search ..... 343/702
See application file for complete search history.

(56) References Cited

U.S. PATENT DOCUMENTS 4,992,799 A * 2/1991 Garay ..... 343/702
5,668,561 A * 9/1997 Perrotta et al. ..... 343/702
5,977,710 A * 11/1999 Kuramoto et al. ... 343/700 MS
6,356,238 B1 * 3/2002 Gainor et al. ..... 343/718
6,590,540 B1 * 7/2003 Adams et al. ..... 343/718
6,795,028 B1 * 9/2004 Stutzman et al. ..... 343/702
2003/0197651 A1 * 10/2003 Yuanzhu ..... 343/725

FOREIGN PATENT DOCUMENTS

JP 2002-135020 A 5/2002

OTHER PUBLICATIONS

Masato Tanaka and Jae-Hyeuk Jang, "Wearable Patch Antenna," *The Institute of Electronics, Information and Communication Engineers*, B-1-108, 2002 p.: 124.

* cited by examiner

*Primary Examiner*—Tho Phan
(74) *Attorney, Agent, or Firm*—Morgan Lewis & Bockius LLP

(57) ABSTRACT

The object of the present invention is to propose a re-radiating antenna system that efficiently radiates radio waves emitted from the antenna of a portable wireless device and efficiently receives incoming radio waves. To realize this object the re-radiating antenna system according to the present invention comprises coupling means for receiving radio waves radiated from the antenna of a portable wireless device, re-radiating means for re-radiating radio waves received by the coupling means and transmission means for transmitting radio waves received by the coupling means to the re-radiating means. The antenna of the portable wireless device and the coupling means are each formed of patch antennas, and these patch antennas are disposed to oppose each other.

4 Claims, 3 Drawing Sheets

RE-RADIATING ANTENNA SYSTEM

BACKGROUND OF THE INVENTION

1. Field of the Invention

This invention relates to a re-radiating antenna system and more specifically to technology improving a wearable antenna.

2. Description of the Related Art

When carrying a portable wireless device such as a cellular telephone, a cordless telephone or a small transceiver or the like, the device itself is usually inserted inside a garment pocket or it may be placed in a special holder for the purpose which is attached to a belt for example. This brings the antenna of the portable wireless device into close proximity with the body of the carrier however, which leads to the problem of the effect of electromagnetic waves emitted from the portable wireless device on the body of the person carrying the device as well as a problem of a change in the impedance of the antenna which inhibits the antenna effectively radiating radio waves. Further, some of the radio waves emitted from the antenna are absorbed by the body of the carrier leading to the problem that these absorbed radio waves are not used effectively for communication, while there is also a problem of incoming radio waves being prevented from being adequately received. Many different solutions have been investigated to provide means for avoiding the effect on the human body during a conversation using a portable telephone, however even when not being used for a conversation a portable telephone continues transmitting and receiving radio waves. Solutions to the problem of the effects on the human body of electromagnetic waves when a portable telephone is not being used and solutions to the adverse effects that the carrier exerts on an antenna have not been sufficiently investigated. The invention disclosed in Japanese Unexamined Patent Application No. 2002-135020 proposes a solution of a reflector plate attached to the device holder, however efficient transmission and reception of radio waves using this method requires adequate separation of the reflecting plate and the antenna of the portable wireless device which raises further issues of practicality.

To provide an effective antenna that can be carried while walking, research is being conducted on wearable patch antennas that allow an antenna to be housed in clothing or a hat for example (The Institute of Electronics, Information and Communication Engineers B-1-108, 2002). This antenna has various features such that the effect on the human body of electromagnetic waves radiation is small, it can be installed in a high position on the human body to alleviate effects on people and things near the antenna, and so on, however thus far the problem of the method of power supply for the antenna has not been adequately investigated. If for example a solid part like a connector or the like is used with a power supply means for an antenna it creates difficulties attaching the antenna to the body, detracting from the advantages offered by having a wearable antenna constructed of a flexible material. It also has other disadvantages such as the need to connect apparel in which the antenna is housed with a portable wireless device.

Further, when the portable wireless device is placed in a location such as a room for example where it is difficult for radio waves to reach, it is effective to have an externally connected antenna for installation outside for connection to the portable wireless device, however this requires a connector to connect the externally attached antenna to the portable wireless device but the act of disconnecting and reconnecting is inconvenient.

SUMMARY OF THE INVENTION

In this respect the present invention deals with the problem of providing a re-radiating antenna system and portable wireless device holder enabling efficient radiation of radio waves emitted from the antenna of a portable wireless device and efficient reception of incoming radio waves. A further problem requiring a solution by the present invention is the problem of providing a wearable antenna that can be more conveniently attached to the wearer and which has a reduced effect of electromagnetic waves on the human body.

In order to solve the above problems the re-radiating antenna system according to the present invention is a re-radiating antenna system comprising coupling means for receiving radio waves radiated from the antenna of a portable wireless device, re-radiating means for re-radiating radio waves received by the coupling means and transmission means for transmitting radio waves received by the coupling means to the re-radiating means, wherein the antenna of the portable wireless device and the coupling means are each formed of patch antennas, disposed mutually opposing each other. This configuration allows radio waves to be transmitted and received between a portable wireless device and the re-radiating antenna system with very little loss, enables radio waves radiated from the portable wireless device to be effectively re-radiated and enables incoming radio waves requiring reception to be effectively received. Further, usage of a patch antenna for a coupling means enables construction of this antenna system in a very thin form.

It is preferable for the transmission means of the re-radiating antenna system according to the present invention to transmit radio waves through the electromagnetic coupling of the coupling means and the re-radiating means. Such a configuration enables the re-radiating antenna system to have a simple construction.

The portable wireless device holder according to the present invention houses the re-radiating antenna system of the present invention. Enabling the portable wireless device to be accommodated in the portable wireless device holder means that rather than using parts such as a connector or the like the portable wireless device and the re-radiating antenna system are electromagnetically coupled, thereby avoiding the troublesome act of attaching/detaching them.

The wearable antenna according to the present invention comprises the re-radiating antenna system of the present invention accommodated on the clothing of the carrier; the coupling means, re-radiating means and transmission means thereof being formed of flexible materials. This configuration dispenses with parts such as a connector and the like, retaining the advantages of a system that can be accommodated by clothing without obstructing the wearer's movements. Further, the ground plane of the wearable antenna shelters the user's body from radiated electromagnetic waves thereby reducing their effect on the human body.

DESCRIPTION OF THE PREFERRED EMBODIMENTS

Embodiment 1

Figure 1:
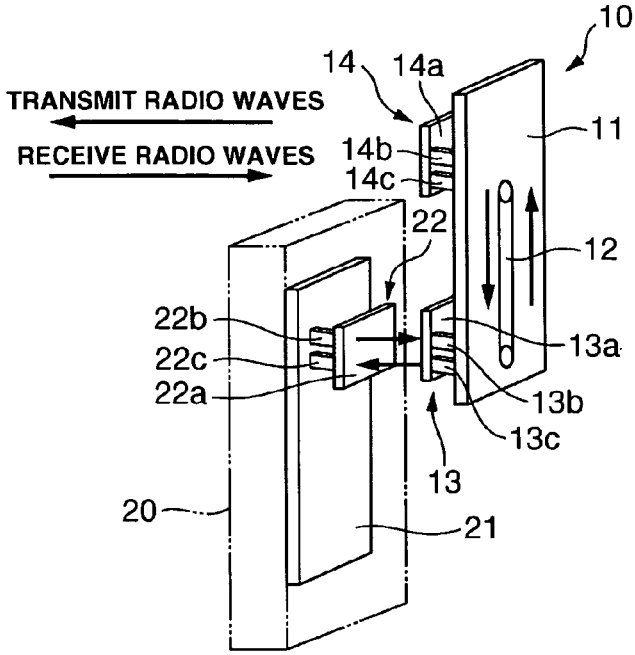
FIG. 1 shows the configuration of a re-radiating antenna system according to a first embodiment of the present invention.

FIG. 1 shows the configuration of a re-radiating antenna system 10 according to a first embodiment of the present invention. The system 10 is an antenna device that receives radio waves radiated from the portable wireless device 20 and re-radiates these waves into the atmosphere as well as re-radiating incoming radio waves received to the portable wireless device 20. Inside the portable wireless device 20 is housed a patch antenna 22 that is radio wave radiating means comprising a radiating plate 22*a* supported by a support pin 22*c* such that it is disposed roughly parallel in relation to a ground plane (an earthing board) 21. High frequency signals from a wireless circuit not shown in the drawings are supplied through a power supply pin 22*b*. Output radio waves are radiated from the patch antenna 22 to the re-radiating antenna system 10.

The re-radiating antenna system 10 provides a patch antenna 13 that is coupling means electromagnetically coupling the portable wireless device 20 and the re-radiating antenna system 10 through receiving output radio waves radiated from the patch antenna 22, a patch antenna 14 that is re-radiating means that re-radiates output radio waves received by the patch antenna 13 toward the atmosphere, and a microstrip line 12 that is transmission means that transmits output radio waves received by the patch antenna 13 to the patch antenna 14. Besides the function of re-radiating means for re-radiating radio waves, the patch antenna 14 receives incoming radio waves and, via the microstrip line 12, transmits the radio waves received to the patch antenna 13. The patch antenna 13 transmits the radio waves thus received to the patch antenna 22.

The microstrip line 12 is a signal transmission path formed on the dielectric layer of a printed circuit substrate 11. The ground plane of the microstrip line 12 is formed on the reverse surface of the printed circuit substrate 11. This ground plane is used jointly as a ground plane for the patch antennas 13 and 14. The patch antennas 13 and 14 comprise respectively, radiating plates 13*a* and 14*a* each arranged in opposition to the ground plane at a prescribed distance therefrom, support pins 13*b* and 14*b* for supporting the radiating plates 13*a* and 14*a* respectively and power supply pins 13*c* and 14*c* for supplying power to the radiating plates 13*a* and 14*a* respectively. The power supply pins 13*c* and 14*c* are connected to the microstrip line 12, so constructed as to enable transmission and reception of high frequency signals between the patch antennas 13 and 14. The support pins 13*b* and 14*b* and the power supply pins 13*c* and 14*c* can be realized by performing folding processes on the radiating plates 13*a* and 14*a*.

It is preferable for the patch antenna 13 which serves as coupling means, to be positioned such that radio waves can be transmitted to and received from the patch antenna 22 with the lowest degree of loss possible. A design wherein the radiating plate 13*a* and the radiating plate 22*a* are mutually facing each other enables efficient transmission and reception of radio waves between them. Further, as shown in FIG. 1, in order to provide means for electromagnetically coupling the portable wireless device 20 and the re-radiating antenna system 10, the patch antennas 13 and 22 should be of a thin type construction. Using the patch antennas 13 and 22 dispenses with the need to use a part like a connector for example, and simply positioning them in this way, in opposition to each other, enables electromagnetic coupling of the portable wireless device 20 and the re-radiating antenna system 10.

Different kinds of antenna in addition to the above described patch antenna 14 can be used for re-radiating means, however using the patch antenna 14 as described enables the re-radiating antenna system 10 to be constructed in a thin form and reduces the number of parts used. Further, utilizing the directivity of the patch antenna 14 in a design such that radio waves are not radiated towards the body of the wearer enables the effect of electromagnetic waves on the wearer's body to be reduced. The portable wireless device 20 can be any kind of portable wireless equipment such as the handset of a cordless telephone, a cellular phone or a transceiver or the like.

The re-radiating antenna system 10 according to this embodiment of the present invention realizes performance of transmission and reception of radio waves between the portable wireless device 20 and the re-radiating antenna system 10 with very little loss, enables radio waves radiated from the portable wireless device 20 to be effectively re-radiated and enables incoming radio waves requiring reception to be effectively received. Further, usage of the patch antenna 13 for coupling means enables construction of this antenna system in a very thin form.

Figure 2:
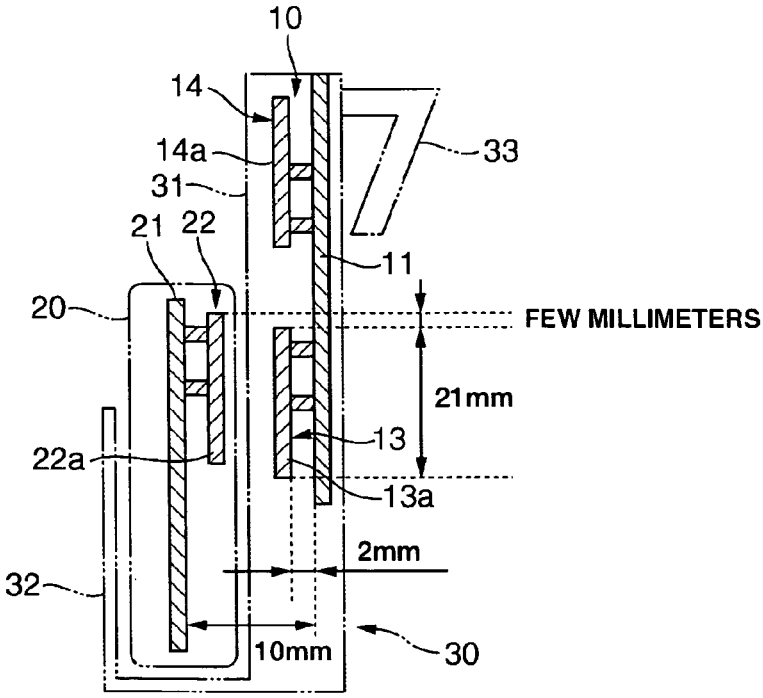
FIG. 2 shows the configuration of a re-radiating antenna system according to the first embodiment of the present invention.

FIG. 2 provides a cross-sectional view of a re-radiating antenna system 10 incorporated inside a portable wireless device holder 30. The portable wireless device holder 30 comprises a main body part 31 that is of a rectangular shape viewed cross-sectionally, a pocket shaped holding enclosure part 32 that accommodates the portable wireless device 20 and an attaching part 33 for attaching the main body part 31 to a belt or the like. This configuration is such that when a re-radiating antenna system 10 as described above is housed in this main body part 31 and the portable wireless device 20 is inserted in the holding enclosure part 32, the patch antenna 22 providing means for radiating radio waves and the patch antenna 13 that is coupling means are positioned mutually facing each other, thereby facilitating low loss transmission and reception of radio waves between the portable wireless device 20 and the re-radiating antenna system 10.

The radio waves radiating means, patch antenna 22, coupling means, patch antenna 13 and re-radiating means, patch antenna 14 can be designed such that they are each the same size. When using for example a 5.8 GHz band cordless telephone as the portable wireless device 20, the radiating plates 22*a*, 13*a* and 14*a* are 21 mm×30 mm in size and the distance of the radiating plates 22*a*, 13*a* and 14*a* from the ground plane 21 and 11 is 2 mm. These dimensions decrease as the frequency of the radio waves increases. For this embodiment the dimensions of each part are designed such that the distance of the ground plane 21 of the portable wireless device 20 from the ground plane 11 of the re-radiating antenna system 10 is approximately 10 mm, while the radiating plate 22*a* and the radiating plates 13*a* relatively shifted by a few millimeters. Such a configuration enables loss in the transference occurring between the portable wireless device 20 and the re-radiating antenna system 10 to be less than 1 dB.

In this way, housing the re-radiating antenna system 10 in the mobile wireless device holder 30 enables the portable wireless device 20 to transmit and receive radio waves via the re-radiating antenna system 10 such that the portable wireless device 20 can efficiently receive and transmit radio waves even when accommodated inside the holder 30. Further, the ground plane 11 inside the holder 30 obstructs electromagnetic waves irradiated towards the wearer's body thereby reducing the effect of electromagnetic waves on the body. Again, usage of the patch antenna 13 housed inside the holder 30 as coupling means electromagnetically coupling the portable wireless device 20 and the re-radiating antenna system 10 dispenses with the need to provide a connection between them in the form of a part such as a cable or a connector, thereby realizing electromagnetic coupling of the portable wireless device 20 and the re-radiating antenna system 10 simply by accommodating the portable wireless device 20 in the holding enclosure part 32.

The disclosure of this embodiment using an example of a configuration wherein the re-radiating antenna system 10 is housed in the portable wireless device holder 30 is illustrative and not restrictive regarding the method by which the holder 30 may be attached to the wearer's body or in the shape or form in which the holder 30 should be constructed; any form that allows a portable wireless device to be attached to the body and carried such as a holder that attaches to the wearer's belt, a shoulder bag or purse that can be hung around the wearer's shoulder and is equipped with a portable telephone pocket or an armlet equipped with a portable telephone holder for example, is suitable.

Embodiment 2

Figure 3:
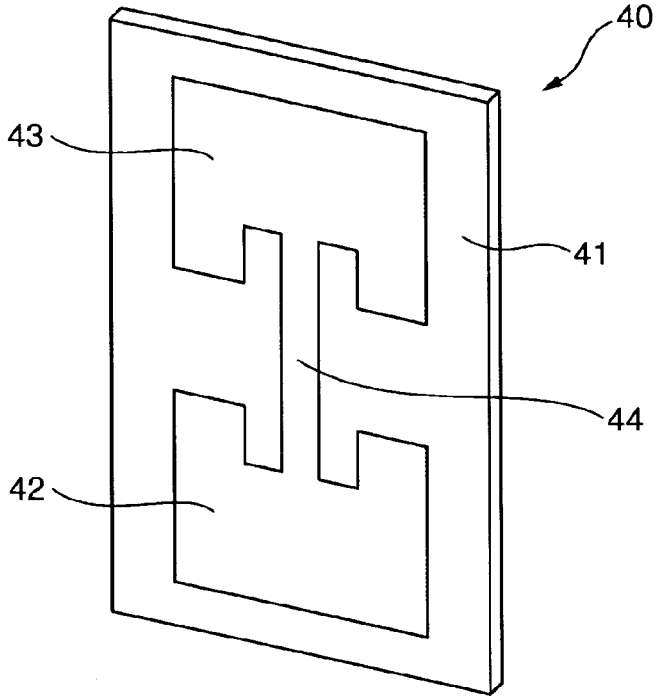
FIG. 3 shows the configuration of a re-radiating antenna system according to a second embodiment of the present invention.

A second embodiment according to the present invention will now be described with reference to FIG. 3. The above described embodiment incorporates a patch antenna formed through bending processes performed on sheet metal, however for this embodiment the patch antenna is formed using a dielectric substrate. As shown in FIG. 3, a re-radiating antenna system 40 comprises a patch antenna 42 serving as coupling means, patch antenna 43 serving as a re-radiating means, and a microstrip line 44 serving as a transmission path connecting the antenna 42 and the antenna 43, formed by applying or pasting a conductive substance on one side of a dielectric substrate 41, while a ground plane is formed by applying or pasting a conductive substance over the reverse surface of the dielectric substrate. Thus, a more compact construction is achieved by forming a patch antenna using a dielectric substrate.

Embodiment 3

Figure 4:
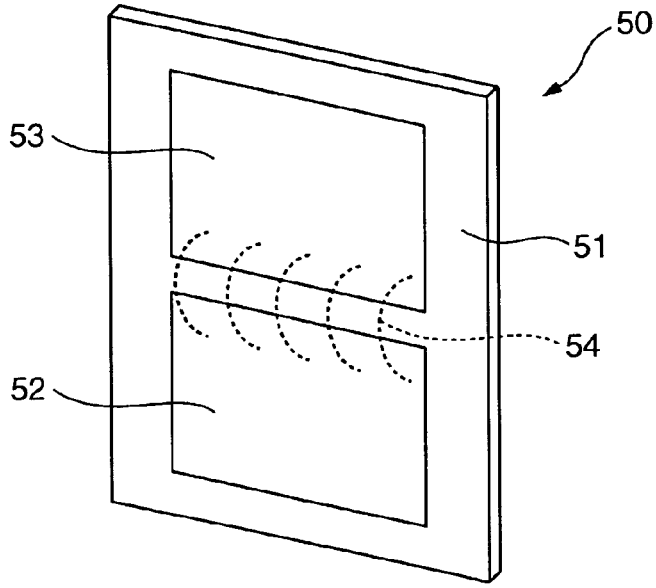
FIG. 4 shows the configuration of a re-radiating antenna system according to a third embodiment of the present invention.

A third embodiment according to the present invention will now be described with reference to FIG. 4. In all of the above described embodiments a microstrip line is used for a transmission path but with this embodiment electromagnetic coupling between patch antennas is used as transmission means, dispensing with an apparent transmission path. As shown in FIG. 4 a re-radiating antenna system 50 comprise a patch antenna 52 serving as coupling means, and a patch antenna 53 serving as re-radiating means, formed by applying or pasting a conductive substance at suitable intervals on one side of a dielectric substrate 51. If these patch antennas 52 and 53 are positioned at a suitably close distance with respect to each other electromagnetic coupling 54 arises between the coupling means and the re-radiating means enabling transmission and receipt between them of high frequency signals to be performed with a low degree of loss. This electromagnetic coupling 54 functions as transmission means, dispensing with an apparent transmission path. Here, an example of this embodiment has been provided using a construction wherein patch antennas are formed on a dielectric substrate, however even where the patch antennas are formed by performing bending processes on sheet metal, apparent transmission means as above can be dispensed with by using the electromagnetic coupling 54.

Embodiment 4

Figure 5:
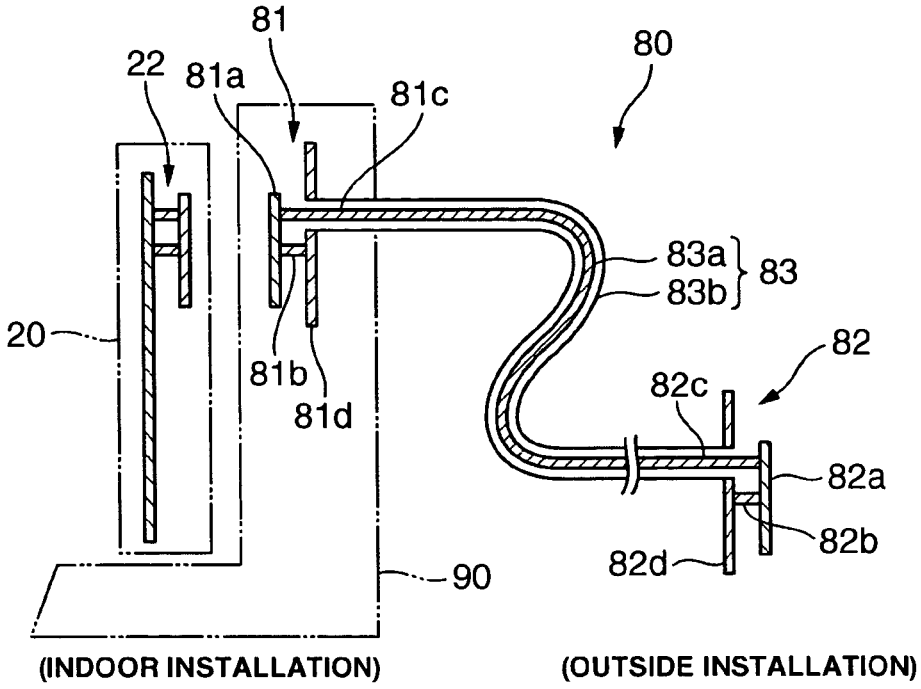
FIG. 5 shows the configuration of a re-radiating antenna system according to a fourth embodiment of the present invention.

A fourth embodiment according to the present invention will now be described with reference to FIG. 5. As for the parts and members with the same reference numerals as those in FIG. 2, description of these parts and members is omitted, deeming that they are the same parts and members as those of FIG. 2. For all of the above described embodiments the coupling means and the re-radiating means are formed integrally or arranged in proximity on a metal plate or dielectric substrate. With this fourth embodiment however the coupling means and the re-radiating means are separate; the coupling between them being formed by transmission means consisting of coaxial cable or the like. As shown in FIG. 5, the re-radiating antenna system 80 comprises a patch antenna 81 serving as coupling means, a patch antenna 82 serving as re-radiating means, and a coaxial cable 83 serving as transmission means. The patch antenna 81 comprises a radiating plate 81*a* arranged roughly parallel in relation to a ground plane 81*d*, a support pin 81*b* that maintains the interval between the radiating plate 81*a* and the ground plane 81*d* constant and a power supply pin 81*c* that supplies power to the radiating plate 81*a*, all of which are built into a charger 90. The patch antenna 81 should be installed in such a position that when the portable wireless device 20 mounts on the charger 90 the patch antenna 81 and patch antenna 22 face each other in a substantially parallel fashion.

The patch antenna 82 comprises a radiating plate 82*a* arranged roughly parallel in relation to a ground plane 82*d*, a support pin 82*b* that maintains the interval between the radiating plate 82*a* and the ground plane 82*d* constant and a power supply pin 82*c* that supplies power to the radiating plate 82*a*. The internal conductor 83*a* inside the coaxial cable 83 is connected to the power supply pins 81*c* and 82*c* and the external conductor 83*b* is connected to the ground planes 81*d* and 82*d*. The patch antenna 81 as coupling means and the patch antenna 82 as re-radiating means are set with a comparatively large distance between them, with for example the patch antenna 81 being installed indoors and the patch antenna 82 being installed outside. With this configuration, even indoors where it is difficult for radio waves to reach, by mounting the portable wireless device 20 on the charger 90 transmission and reception of radio waves can be performed via the patch antenna 82 installed outside thereby enabling efficient transmission and reception of radio waves. Further, because when the portable wireless device 20 is detached from the charger 90 the portable wireless device 20 can transmit and receive radio waves via the patch antenna 22, this eliminates the bother of having to detach the re-radiating antenna system 80. The example provided for this embodiment of a construction wherein the patch antennas and 81 and 82 are formed by bending processes performed on sheet metal is illustrative and not restrictive and the coupling means and the re-radiating means may be formed using a dielectric substrate.

Embodiment 5

Figure 6:
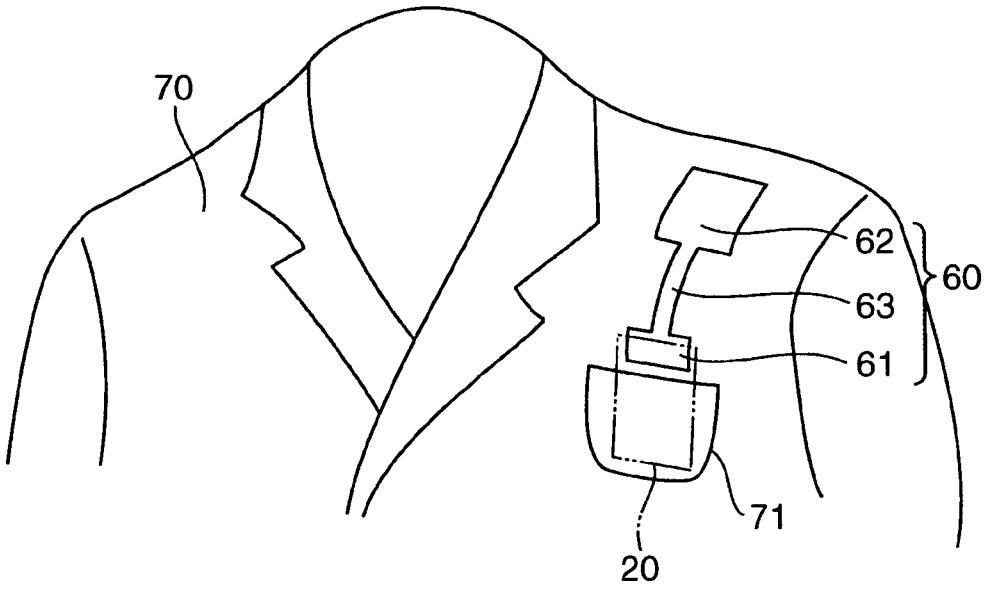
FIG. 6 shows the configuration of a re-radiating antenna system according to a fifth embodiment of the present invention.

The fifth embodiment will now be described with reference to FIG. 6. This embodiment provides a re-radiating antenna system as described in detail with respect to each of the embodiments above, that is constructed of flexible materials and may be mounted on clothing as a wearable antenna. Here, a pocket 71 for accommodating the portable wireless device 20 is positioned in contact with the chest region of a garment 70 and a wearable antenna 60 is mounted extending from the chest part to the shoulder part. The wearable antenna 60 is a re-radiating antenna system comprising a patch antenna 61 serving as coupling means for electromagnetically coupling the portable wireless device 20, a patch antenna 62 serving as re-radiating means that re-radiates radio waves, and a microstrip line 63 as transmission means that connects the patch antennas 61 and 62. These patch antennas 61 and 62 and the microstrip line 63 are formed of flexible, bendable materials. A sandwich type construction, wherein for example both surfaces of a dielectric layer are inserted in a conducting layer, provides a suitable structure for the wearable antenna 60, and bendable, flexible materials should be used for these dielectric and conducting layers. The patch antenna 61 as coupling means should be in contact with the prescribed position on the garment 70 such that when the portable wireless device 20 is accommodated in the pocket 71 the patch antenna 61 is positioned opposing the patch antenna 22. The transmission means, microstrip line 62, is not absolutely essential, and can be dispensed with through using the same kind of electromagnetic coupling as is used with the third embodiment.

According to the configuration of this fifth embodiment, high frequency radio waves radiating from the portable wireless device 20 accommodated in the pocket 71 are received by the patch antenna 61 and transferred to the patch antenna 62 via the microstrip line 63, thereby dispensing with the need to use a solid part such as a connector or the like for coupling means. Further, as there is no detraction from the required feature of a wearable antenna that when attached to the clothing there is no obstruction to the movements of the wearers body, this configuration is conducive to the provision of a suitable method of power supply for a wearable antenna. Again, as there is no need to use a connecting part such as a connector or the like to connect the portable wireless device 20 and the wearable antenna 60, this embodiment is simple and easy to handle. Moreover, as a membranous conducting layer that functions as a ground plane for the patch antennas 61 and 62 is formed on the reverse side of the wearable antenna 60, the ground plane obstructs the wearers body from irradiation with electromagnetic waves thereby reducing the effect of electromagnetic waves on the wearer's body.

The disclosure of this embodiment providing an example of a construction wherein the wearable antenna 60 is mounted on a garment 70 is illustrative and not restrictive and mounting of the antenna on any kind of clothing such as a hat, a suit, work clothing, sportswear, a raincoat, a dress, kimono, apron, overalls, a jumper, trousers or the like, or mounting the wearable antenna 60 on anything formed of a flexible material such as a holder that attaches to the wearer's belt, a shoulder bag or purse that can be hung around the wearer's shoulder and is equipped with a portable telephone pocket or an armlet equipped with a portable telephone holder for example, is also suitable.

What is claimed is:

1. A re-radiating antenna system comprising:

a coupling means for receiving radio waves radiated from the antenna of a portable wireless device;

a re-radiating means for re-radiating radio waves received by said coupling means; and a transmission means for transmitting radio waves received by said coupling means to said re-radiating means, wherein said antenna of said portable wireless device and said coupling means are each formed of a patch antenna, these patch antennas being disposed in opposition to each other, wherein a loss in transference between said portable wireless device and said coupling means is less than 1 decibel (db).

2. The re-radiating antenna system according to claim 1, wherein said transmission means transmits said radio waves by electromagnetic coupling of said coupling means and said re-radiating means.

3. The re-radiating antenna system according to either of claims 1 or 2, including a portable wireless device holder.

4. The re-radiating antenna system according to either of claims 1 or 2, including a wearable antenna mounted on clothing, wherein said coupling means, said re-radiating means and said transmission means of said wearable antenna are comprised of flexible materials.

* * * * *